US005309336A

United States Patent [19]

Hartt et al.

[11] Patent Number: 5,309,336

[45] Date of Patent: May 3, 1994

[54] UNIVERSAL CONNECTOR AND AUTOMOTIVE CIGARETTE LIGHTER ASSEMBLIES AND RECHARGEABLE FLASHLIGHT INCORPORATING SAME

[75] Inventors: Joseph Hartt; Joseph E. Velazquez, both of Englewood, Colo.

[73] Assignee: Millennia Corporation, Englewood, Colo.

[21] Appl. No.: 651,599

[22] Filed: Feb. 6, 1991

[51] Int. Cl.[5] ..... F21L 7/00

[52] U.S. Cl. ..... 362/183; 362/206; 362/207; 362/348; 320/2

[58] Field of Search ..... 362/183, 203, 205, 206, 362/207, 190, 191, 398; 200/60; 355/205, 207; 320/2

[56] References Cited

U.S. PATENT DOCUMENTS

| | | | |
|---|---|---|---|
| 2,312,670 | 3/1943 | Olds | 362/207 |
| 3,201,542 | 8/1965 | Hutchison | 362/310 |
| 3,980,979 | 9/1976 | Prosser et al. | 335/207 |
| 4,075,470 | 2/1978 | Moore | 362/398 |
| 4,734,832 | 3/1988 | Moriano et al. | 362/190 |
| 4,782,432 | 11/1988 | Coffman | 362/183 |
| 5,008,785 | 4/1991 | Maglica et al. | 362/183 |
| 5,036,444 | 7/1991 | Hiles | 362/188 |
| 5,122,938 | 6/1992 | Pastusek | 362/203 |

*Primary Examiner*—Ira S. Lazarus
*Assistant Examiner*—Y. Quach
*Attorney, Agent, or Firm*—Fields, Lewis, Pittenger & Rost

[57] ABSTRACT

A rechargeable flashlight for automotive use having a universal connector for drawing power from any type of cigarette lighter receptacle. The universal connector includes a ring-shaped portion which establishes a friction connection with the positive feed portions of the cigarette lighter receptacles, and a cylindrical portion for establishing a friction fit with the cylindrical inner housing of the receptacles to establish contact with the negative feed or ground. The rechargeable flashlight and the universal connector can be integral in a single body, the body housing a rechargeable battery, lens/-lamp assembly and spare bulbs. A magnetic foot is hingedly attached to the flashlight body for permitting the flashlight to be mounted on any magnetically responsive material and providing a directable flashlight beam. Alternatively, the universal connector can be separate and provide current to any desired electrical appliance.

19 Claims, 7 Drawing Sheets

Fig_1A
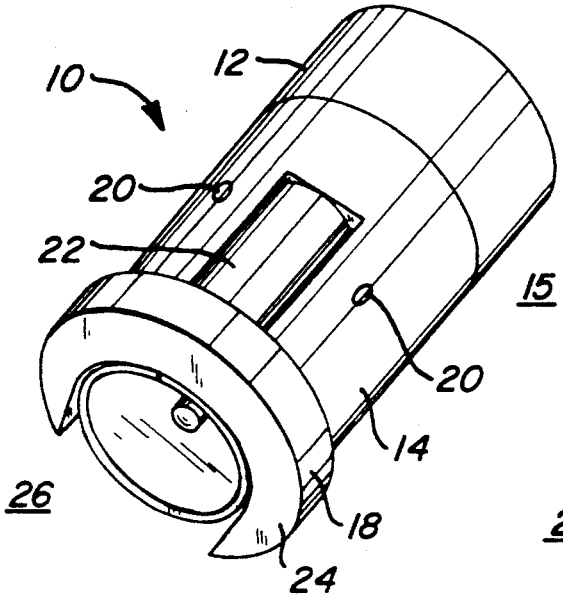
Fig_1B
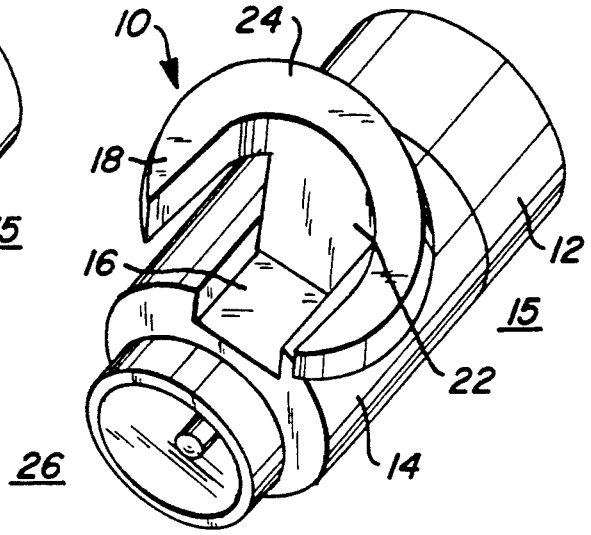
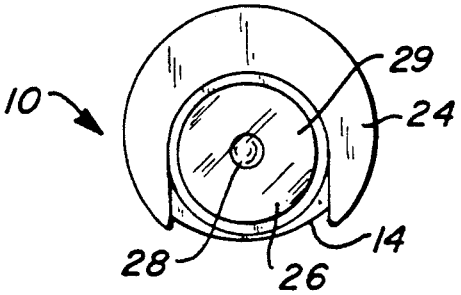
Fig_1C
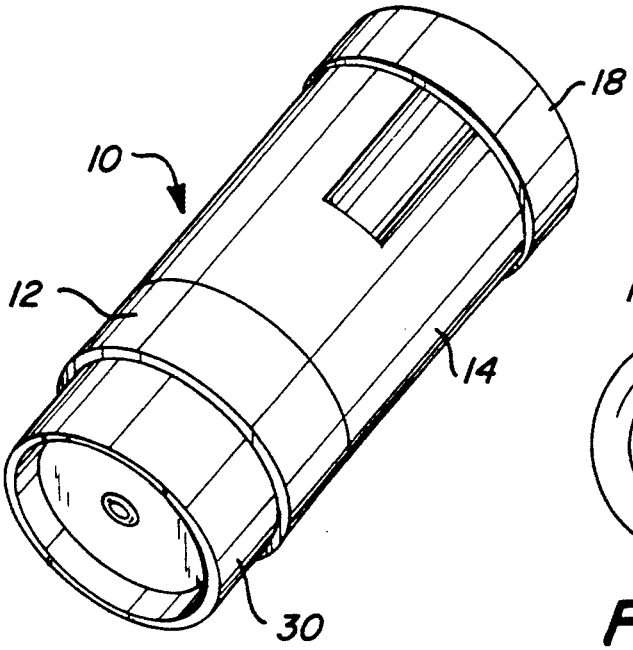
Fig_2A
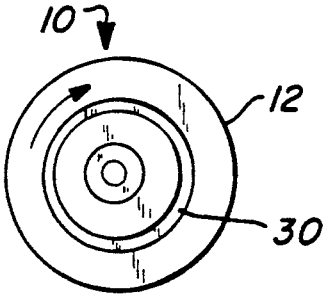
Fig_2B Fig_15C
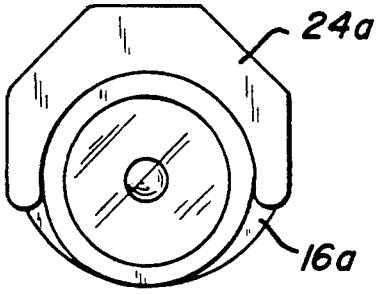
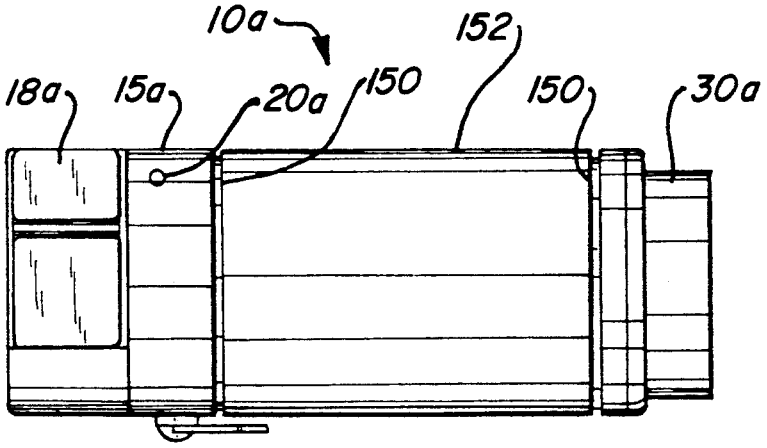
Fig_15A
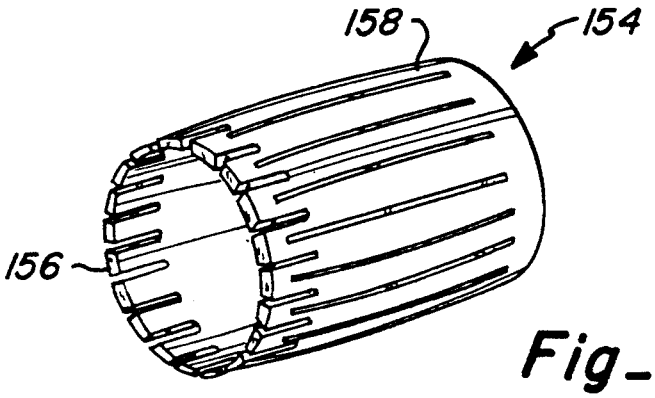
Fig_16

UNIVERSAL CONNECTOR AND AUTOMOTIVE CIGARETTE LIGHTER ASSEMBLIES AND RECHARGEABLE FLASHLIGHT INCORPORATING SAME

BACKGROUND OF THE INVENTION

Field of the Invention

The present invention relates to a universal connector for cigarette lighter assemblies. More particularly, the present invention is directed to a universal connector that can, for example, be incorporated in a rechargeable flashlight for electrically connecting the rechargeable flashlight to an automotive electrical system via an automobile cigarette lighter receptacle.

2. Description of the Related Art

Connectors, or plugs, have been available for some time which draw electricity from the cigarette lighter receptacle of an automobile. These plugs provide electricity for a wide variety of portable electrical devices, from rechargeable flashlights to laptop computers. However, a number of drawbacks are associated with the plugs presently available. Typically, automobiles in the United States include one of two types of cigarette lighter receptacles. The inventors are aware of no plug presently available which overcomes the structural differences between the two types of receptacles to establish a reliable positive electrical connection via a friction fit with the positive feed portions of both types of receptacles.

In order to be useful for both types of receptacles, most plugs presently in use are maintained within the receptacle by pressure provided by a spring-mounted device against a side wall of the receptacle, with positive electrical contact being provided by simply touching an inner conductor to the positive feed portion of the cigarette lighter receptacle. Given the vibrations that most vehicles experience, such plugs have inherent reliability problems, as contact between conductors can be easily lost. Additionally, such contact is not conducive to drawing large amounts of current through the plug.

One major application for such plugs is rechargeable flashlights. Typically, a plug draws current from the automotive electrical system for recharging a battery associated with the flashlight. For example, U.S. Pat. No. 3,825,740, which issued to Friedman et al. on Jul. 23, 1974, U.S. Pat. No. 4,092,580, which issued to Prinsze on May 30, 1978, and U.S. Pat. No. 4,357,648, which issued to Nelson on Nov. 2, 1982, disclose recharqeable flashlights which draw electricity from cigarette lighter receptacles via plugs of the above-described nature.

In view of the problems associated with plugs, many rechargeable flashlights attempt to avoid the cigarette lighter receptacle as a power source altogether. For example, U.S. Pat. No. 4,092,580 discloses that while a plug for a cigarette lighter assembly can be employed, direct wiring into the automobile electrical system is preferable. The rechargeable flashlight provided in U.S. Pat. No. 4,825,345, issued to Stevens on Apr. 25, 1989, also avoids such plugs by providing means that can be plugged into the fuse box of an automobile.

Many flashlights designed for use in automobiles have additional drawbacks. For example, one problem associated with most rechargeable flashlights is their bulk. Many flashlights designed for automobiles are actually part of flashlight systems, which include the flashlight, a flashlight holder that must be mounted in the automobile, and wires which extend from the holder to the automotive electrical system. The Friedman et al. and Prinsze patents describe such flashlights. Since space is often very limited in modern automobiles, no out of the way place exists for mounting holders, and, more often than not, such flashlights systems are obtrusive.

In this regard, flashlights have been developed which mount directly to cigarette lighter receptacles. For example, see U.S. Pat. Nos. 4,224,658 to Siiberg and 4,713,735 to Hiltman. However, more and more automobiles include cigarette lighter receptacles which are stowed away together with ashtrays within a hinged or sliding compartment or the like. In such cases, these flashlights either do not fit or the compartment must remain at least partially open to allow a flashlight to be inserted. Even in cars with conventionally mounted receptacles, these flashlights tend not to fit discretely or unobtrusively.

A further problem with most rechargeable flashlights is that they lack the ability and flexibility to be useful in emergency situations. For example, most vehicle repairs require two hands, and vehicle problems are typically not in locations that can be illuminated by laying a flashlight on the ground or a flat portion of the vehicle.

In light of these problems, a need exists for a connector which can be used with any of the primary types of cigarette lighter receptacles, is not of questionable reliability due to the vibrations associated with vehicles, and can readily and reliably draw a relatively high current if so needed. A need also exists for a reliable and unobtrusive automobile flashlight which can be readily mounted in useful positions during emergency situations.

SUMMARY OF THE INVENTION

Accordingly, one object of the present invention is to provide a universal connector for drawing electricity from either primary type of cigarette lighter receptacle currently in common usage in the United States.

Another object of the present invention is to provide a universal connector which establishes an improved and reliable electrical connection to either primary type of cigarette lighter receptacle.

Still another object of the present invention is to provide a universal connector which is able to establish a electrical connection which is capable of handling the electrical requirements of devices which have large current draws.

Another object of the present invention is to provide a rechargeable flashlight which is cordless, portable, reliable and easy to store.

Yet another object of the present invention is to provide a rechargeable flashlight for an automobile which can be readily mounted so as to be useful for almost any necessary application.

Still another object of the present invention is to provide a rechargeable flashlight which is relatively o simple to manufacture and maintain.

A further object of the present invention is to provide a universal connector which can be adapted for use with cigarette lighter receptacles in common usage both inside and outside the United States.

Yet a further object of the present invention is to provide a rechargeable flashlight mountable in automotive cigarette lighter receptacles which is waterproof.

Other objects and advantages of the present invention will be set forth in part in the description and drawings which follow, and, in part, will be obvious from the description, or may be learned by practice of the invention.

As embodied and broadly described herein, a device is provided for drawing current from a cigarette lighter assembly of the type having an open first end, an inner surface, and at least one extending portion therein for providing electrical current. The device comprises a housing having first and second ends and first means, extending from the first end of the housing, for frictionally engaging at least a portion of the extending portion of the cigarette lighter assembly and drawing current therefrom. The device may include second means, electrically isolated from the first means, for frictionally engaging at least a portion of the inner surface of the cigarette lighter assembly for establishing a negative electrical connection therewith, wherein the first means establishes a positive electrical connection with the extending portion within the cigarette lighter assembly. Further means may be provided for selectively connecting the first engaging means to one of at least two current receiving components or devices. According to one embodiment, the first engaging means and the selective connecting means can comprise a ring-shaped member for establishing the frictional engagement with the extending portion of the cigarette lighter assembly, the ring-shaped member being rotatable relative to the housing for selectively connecting said first engaging means to one of the current receiving components or devices.

The device may further include first and second leads operatively connected to the first engaging means and the second engaging means, respectively, the first and second leads being attachable to an electrical device for providing electricity thereto from the cigarette lighter receptacle. The second engaging means can be coextensive with the housing and comprise a cylinder having a diameter substantially similar to the diameter of the open first end of the cigarette lighter assembly. Additionally, the ring shaped portion of the first engaging means is preferably coaxial with the coextensive housing/second engaging means.

The device may be integral with a flashlight. In this case, the overall device will also include a battery mounted within the housing, the battery being selectively connectable to the first engaging means, and a lamp assembly mounted within the housing, the lamp assembly being selectively electrically connectable with at least one of the battery and the first engaging means.

According to a second embodiment, the integrated flashlight/current drawing device may include magnetic switching means for selectively electrically connecting the battery to the lamp assembly. The magnetic switching means may be actuated by pivoting a magnetic foot which is hingedly mounted in a cutaway portion of the housing.

A rechargeable flashlight assembly according to the present invention is also provided which is attachable to a cigarette lighter assembly of the type which includes an open first end, an inner surface and extending portions in a region defined by the inner surface for supplying a current. The rechargeable flashlight assembly includes a housing having first and second ends, a lamp assembly mounted in the first end of the housing, a rechargeable battery mounted within the housing and means for frictionally engaging at least a portion of the extending portion for establishing an electrical connection thereto. The assembly also includes means for selectively connecting the rechargeable battery, the lamp assembly and the engaging means. The engaging means preferably includes a ring-shaped portion for fictionally engaging at least a portion of the extending portions of the cigarette lighter assembly, the engaging means extending from the second end of the housing. According to one embodiment, the ring-shaped portion is rotatable relative to the housing for selectively electrically connecting the rechargeable battery, the lamp assembly and the engaging means.

In a first embodiment, the lamp assembly can be removable from the housing and may include at least one spare bulb and holder for holding the spare bulb, the holder and spare bulb being accessible when the lamp assembly has been removed from the housing.

According to a second embodiment, the assembly further includes a pivotable magnetic foot which can be used for mounting the flashlight assembly. The assembly can further comprise magnetic switching means for selectively electrically connecting the lamp assembly to the battery. The magnetic switching means can be actuated by rotation of the magnetic foot about its hinge.

The present invention will now be described with reference to the following drawings, in which like reference numbers denote like elements throughout.

BRIEF DESCRIPTION OF THE DRAWINGS

FIG. 1A is a front perspective view of a rechargeable flashlight according to the present invention;

FIG. 1B is a front perspective view of the rechargeable flashlight illustrated in FIG. 1A having a magnetic foot rotated out of its recharging position;

FIG. 1C is a front view of the flashlight of FIG. 1A with the magnetic foot in its recharging position;

FIG. 2A is a rear perspective view of the flashlight of FIG. 1A;

FIG. 2B is a rear view of the flashlight of FIG. 1A;

FIG. 15A is a side view of a rechargeable flashlight according to a second embodiment of the present invention.

FIG. 15C is a front view of the flashlight of FIG. 15A;

FIG. 16 is a perspective view of an adaptor for adapting the rechargeable flashlight of FIG. 15A for use with cigarette lighter assemblies having relatively large diameters;

DESCRIPTION OF THE PREFERRED EMBODIMENTS

Figure 3A:
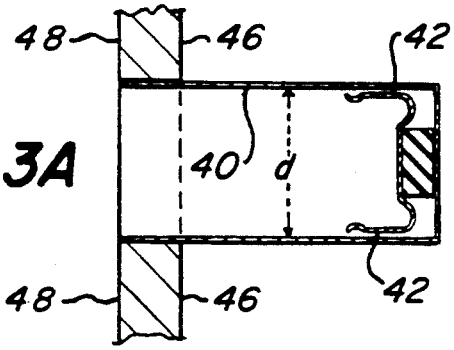
FIG. 3A is a cross-sectional side view of a first type of cigarette lighter receptacle.

A universal connector or plug according to the present invention will first be described in first and second embodiments in which the universal connector according to the present invention extends from one end of a rechargeable flashlight. A rechargeable flashlight is but one use for the universal connector, but demonstrates its use and effectiveness. The rechargeable flashlight according to the first and second embodiments are designed to have the universal connector plugged directly into a cigarette lighter assembly. The device according to the first embodiment is designed to be on the order of between two and five inches long, and is primarily designed for use with cigarette lighter receptacles which are not stowed in a compartment of some type. The flashlight according to the second embodiment is designed to be on the order of between two and two and one half inches in length and can fit within the limited space provided when cigarette lighter receptacles are mounted within closable compartments.

FIRST EMBODIMENT

Referring now to FIGS. 1A–1B, a rechargeable flashlight 10 according to a first embodiment of the present invention is illustrated. The flashlight 10 includes a cylindrical portion 12 located toward the rear end of the flashlight 10. The rear cylindrical portion 12 is preferably formed from a conductive material and establishes electrical contact with nibs which comprise at least a portion of the interior surface of the housing of a cigarette lighter receptacle when the flashlight 10 is inserted into the receptacle (rear end first) for charging and storage. Typically, the nibs are connected to ground or to the negative terminal of a battery, such as a 12 volt automotive battery. A front portion 14 may be composed of any suitable material but is preferably also cylindrical and conductive in nature. The rear cylindrical portion 12 and the front portion 14 in combination may comprise a cylindrical body and provide a housing 15 for the rechargeable flashlight 10.

The front portion 14 is illustrated as being a cylinder which is coextensive with the rear cylindrical portion 12. This configuration is quite useful when size is critical. However, the front portion 14 can have nearly any shape, and larger front portions will support larger lamp assemblies, thereby providing more light.

The front cylindrical portion 14 includes a cutaway portion 16 in which a hinged magnetic foot 18 is partially housed when the magnetic foot 18 is not in use. The magnetic foot 18 is mounted within the cutaway portion 16 on a friction hinge 20, the ends of which are illustrated in FIG. IA where they extend to the surface of the housing 15. A first portion 22 of the magnetic foot 18 seats in the cutaway portion 16 and includes the hinged end of the magnetic foot 18 at a first end thereof. Preferably, a second portion 24 of the magnetic foot 18 is substantially U-shaped, although other shapes can be employed, and connects to a second end of the first portion 22. The second portion 24 is preferably substantially perpendicular to the first portion 22. The U-shaped portion 24 extends around substantially three sides of the portion of a lens/lamp assembly 26 which protrudes from a front end of the front cylindrical portion 14. Preferably, the width of the U-shaped portion 24 at its widest point is somewhat larger in some dimension than the diameter of the front cylindrical portion 14 or otherwise extends past the surface of the cylindrical portion 14 so as to prevent the rechargeable flashlight 10 from being inserted backwards into a cigarette lighter receptacle.

FIG. 1C is a front view of the rechargeable flashlight 10. The relationship between the U-shaped portion 24 of the magnetic foot 18 and the lens/lamp assembly 26 is more clearly illustrated in FIG. 2A. Additionally, the relative width of the U-shaped portion 24 to the diameter of the front cylindrical portion 14 can be more clearly discerned. Included in the lens/lamp assembly 26 are a bulb 28 and a reflector 29.

FIG. 2A is a rear perspective view and FIG. 2B is a rear view of the rechargeable flashlight 10. Illustrated in FIGS. 2A and 2B is the ring-shaped connector 30 which extends from the back of the rechargeable flashlight 10 in this embodiment. This end of the flashlight 10 is inserted into a cigarette lighter receptacle, and the ring-shaped connector 30 establishes a friction fit with the positive feed portion of the cigarette lighter receptacle. In this embodiment, the ring-shaped connector 30 is rotatable with respect to at least the cylindrical portion 12. Rotation of the connector 30 relative to the housing 15 operates a switch which in a first position causes electricity to be fed from a battery 60 (FIG. 4) housed in the flashlight 10 to the bulb 28, thereby lighting the flashlight 10, and in a second position connects the ring-shaped connector 30 to the battery 60 for charging the battery, the bulb 28 being off in this position. This will be explained in more detail below.

Figure 3B:
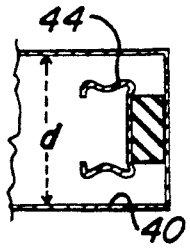
FIG. 3B is a cross-sectional view of a second type of cigarette lighter receptacle.

FIGS. 3A and 3B illustrate the two primary types of cigarette lighter receptacles available in the United States in cross section. A significant factor to the present invention is that the substantially cylindrical receptacle or socket 40 for both of the types of cigarette lighter receptacles has substantially the same diameter d. This cylindrical portion 40 of the receptacles includes spring-loaded nibs (not shown) which provide the negative or ground connection to the cylindrical portion 12 of the rechargeable flashlight 10 when the flashlight 10 is inserted therein. Accordingly, the diameter of the cylindrical portion 12 is designed to be slightly less than that of the cylindrical receptacle 40 so as to provide a friction fit and establish the appropriate electrical connection with the nibs. Alternatively, the cylindrical portion 12 can include only a conductive portion or be substantially non-conductive and include a conductive knob portion extending beyond the area defined by the cylindrical portion 12.

Significant to this embodiment is the connection between the ring-shaped connector 30 and the respective positive electrical feed portions in the form of laterally spaced pairs of integral prongs 42 and 44, respectively, of the respective types of cigarette lighter receptacles. The prongs 42, 44 are formed as the ends of generally U-shaped members, shown in FIG. 3, which extend from the closed interior ends of the respective cigarette lighter receptacles, and are spring loaded to retain the friction fit. Prongs 42, 44 are connected to the end of the respective cigarette lighter receptacles in a conventional manner. Preferably, the connector 30 is more rigid than the prongs 42, 44. The inventors have found that a ring-shaped connector of the appropriate size will slip just inside the electrical feed prongs 42 of the first type of receptacle, establishing good electrical contact through a friction fit therewith, and will slide around the prongs 44 of the second type of receptacle, enclosing the prongs 44 and once again establishing a reliable electrical contact through a friction fit. Such electrical connections, as established by the ring-shaped connector 30, are substantially superior to the contacts now available in prior art universal plugs, as the contacts provided by the present invention will not be substantially affected by the inherent vibrations of an automobile and will reliably conduct substantially higher current values.

The length of the cylindrical receptacle 40 of each type of cigarette lighter receptacle is somewhat different. In the first type of receptacle (that associated with prongs 42), the cylindrical receptacle 40 ends at surface plane 46. In the second type of cigarette lighter receptacle (that associated with prong 44), the cylindrical receptacle 40 ends at surface plane 48. In this regard, the overall length of the rechargeable flashlight 10 is designed taking the differing receptacle depths into account. In this embodiment, the total length can range from approximately two and one-half to five inches. Although longer lengths are possible, this range provides a flashlight which is substantially unobtrusive when employed with conventionally-mounted lighter receptacles.

Figure 4:
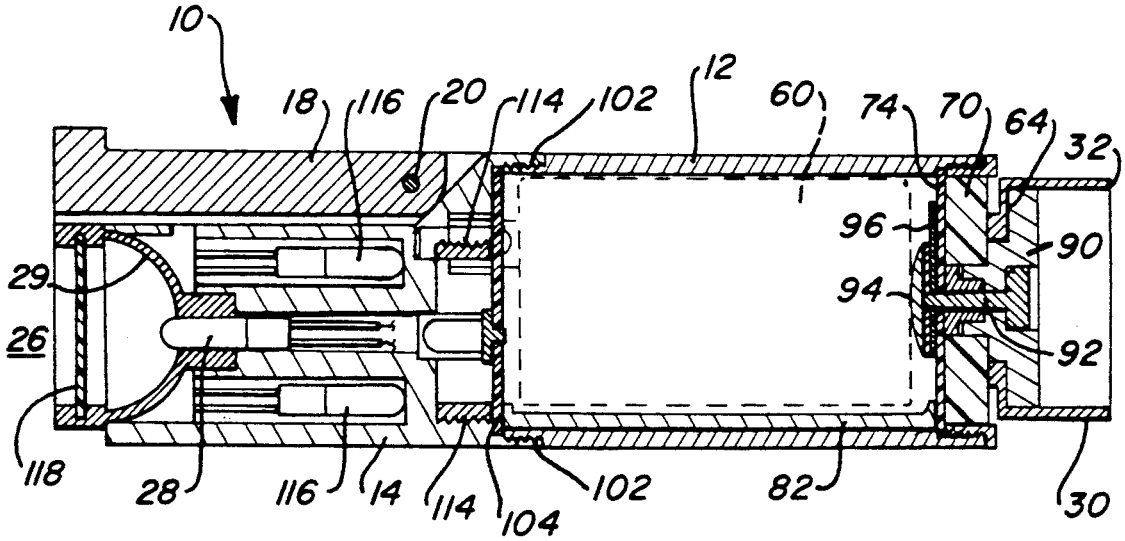
FIG. 4 is a cross-sectional side view of the flashlight of FIG. 1A.

FIG. 4 illustrates the rechargeable flashlight 10 in cross section. Details of the ring-shaped connector 30 are more clearly illustrated in FIG. 4. Preferably, the outside diameter of the connector 30 is approximately 11/16 inches, and the thickness of the ring itself is approximately 1/32 inches. This permits the desired frictions fit between the connector 30 and the prong types of either cigarette lighter receptacle. Although not illustrated in FIG. 4, the outer surface of the connector 30 is not smooth, but preferably includes parallel ridges in the axial direction in order to establish a better contact with the receptacle prongs. The connector 30 is constructed from an appropriate conducting material.

Figure 5A:
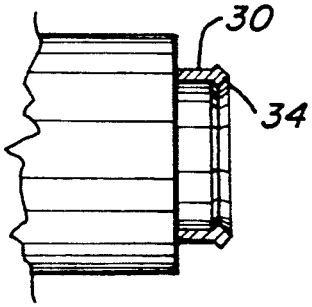
FIG. 5A is a side view partially in cross section of a connector having an expanded edge.
Figure 5B:
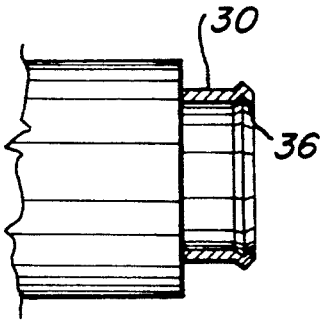
FIG. 5B is a side view partially in cross section of the connector having a knurled edge.

Preferably, the surface of an outer edge 32 of the ring-shaped connector 30 is perpendicular to the inner and outer surfaces of the connector 30 or can be tapered. The inventors have found that a ring-shaped connector 30 with either edge establishes a very stable fit with the prongs of either cigarette lighter receptacle. In fact, the electrical connection established in this way is suitable to situations in which current requirements are much higher than those for a flashlight. However, in extreme situations in which vehicle jarring and vibrations may be extremely severe, the edge of the ring-shaped connector 30 may be adapted to ensure a high quality electrical connection. For example, FIG. 5A illustrates an edge 34 of a connector 30 which is slightly expanded to form a diamond shaped edge. Additionally, FIG. 5B illustrates a connector 30 in which an edge 36 is formed to have a knurled or "S" shape.

In the first embodiment, the ring-shaped connector 30 is rotatably mounted at the rear end of the rechargeable flashlight 10 so that the rotation of the ring-shaped connector 30 relative to the housing 15 of the rechargeable flashlight 10 will act as a switch by the rotation of a wiper switch 58. In this regard, the actual potential rotation of the ring-shaped connector 30 is only a fraction of a full rotation. This rotation may establish electrical connections between several combinations of electrical components, such as the connector 30 to the bulb 28, the connector 30 to the battery 60, and the battery 60 to the bulb 28. In the first embodiment, this partial rotation functions to connect a portion of a circuit including the battery 60 to one of two remaining portions of the circuit. The circuit is illustrated schematically in FIG. 6.

Figure 6:
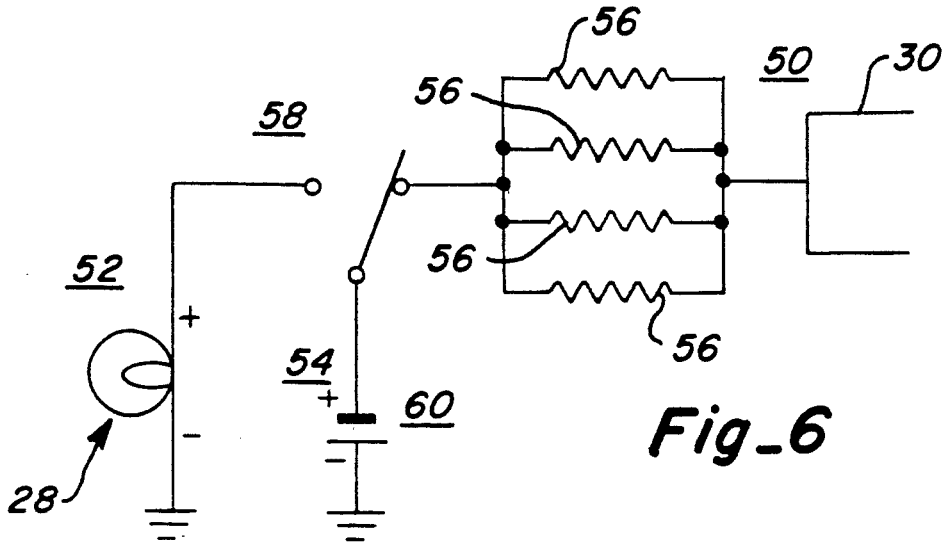
FIG. 6 is a circuit diagram for the flashlight according to the present invention.

As illustrated in FIG. 6, the ring-shaped connector 30 is part of a first portion 50 of the circuit. In first portion 50, current is drawn from the automobile electrical system first through the ring-shaped connector 30 and then through four voltage-reducing and current-limiting resistors 56. The resistors 56, which can be 1000 ohm ¼ watt resistors, are connected in parallel and function to reduce the voltage and current coming from the auto battery or automotive electrical system to a level which is appropriate for both the battery 60 and the bulb 28. Alternative to the resistors 56, any kind of current limiting means can be employed to reduce the voltage and current entering the circuit via the ring-shaped connector 30 to a desired level. In applications in which a current larger than that provided by a 12-volt battery is required, an appropriate adaptor should be provided for use with the ring-shaped connector 30 for increasing the current.

Alternatively, a combination of resistors and diodes, such as a zener diode, can be employed to reduce the voltage, limit the current and prevent the reverse flow of charge. Such a structure is illustrated and described more fully with respect to the second embodiment. A typical 12-volt automotive battery outputs 14 volts when the automobile is running and 12 volts when the engine is off. To prevent unnecessary drainage of the automobile battery, a zener diode is introduced into the circuit following the resistors so that a trigger point is introduced such that when the voltage entering the diode from the resistors is higher than predetermined level, the diode will conduct charge to the battery. Conversely, when the voltage is less than the predetermined level, the rechargeable battery will not be charged by the automotive electrical system. The zener diode also prevents a reverse flow of charge from the rechargeable battery 60 to the automotive electrical system.

As mentioned above, a wiper switch 58 is a two-position switch which, in the preferred embodiment, is controlled by rotation of the ring-shaped connector 30 relative to the housing 15 of the rechargeable flashlight 10 between a first position and a second position. When the switch 58 is in the second position, no electricity is supplied to a second portion 52 of the circuit, which includes the bulb 28. Rather, the current drawn through the ring-shaped connector 30 and the resistors 56 functions to charge the rechargeable battery 60, which is the primary component of a third portion 54 of the circuit. The switch 58 is schematically illustrated in this second position in FIG. 6. The first position of the switch 58 connects the rechargeable battery 60 to the bulb 28 and thereby causes the bulb 28 to be illuminated. As will be appreciated by those skilled in the art, the switch 58 can be any of a number of type of switches other than a wiper switch and need not be actuated by rotation of the ring-shaped connector 30. Similarly, it is preferred that the battery 60 be a single nickel cadmium battery selected for its ability to fit within the space allocated within the flashlight 10. A plurality or different types of batteries can be used in place of the single nickel cadmium battery 60.

Referring once again to FIG. 4, the structure of the flashlight 10 will now be described in more detail.

The negative leads from both the bulb 28 and the battery 60 are connected to the housing 15, which provides the appropriate electrical connection, as discussed above.

Figure 7:
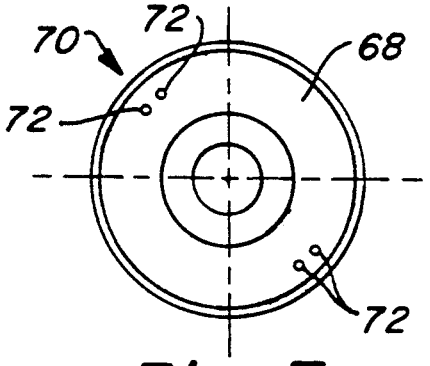
FIG. 7 is a rear view of a resistor housing mounted in the rear of the flashlight of FIG. 1A.
Figure 8:
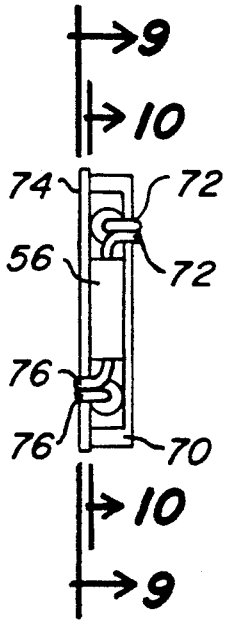
FIG. 8 is a cross-sectional side view of the resistor housing of FIG. 7.
Figure 9:
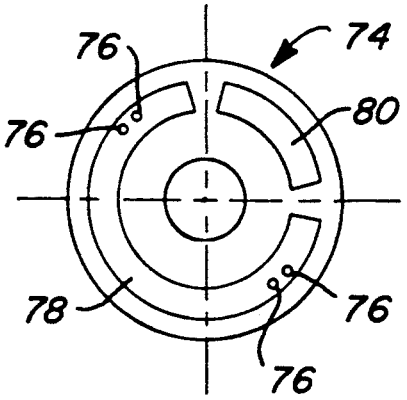
FIG. 9 is a front view of a front dielectric sheet which forms a front cover of the resistor housing of FIG. 8 along the section A—A of FIG. 8.
Figure 10:
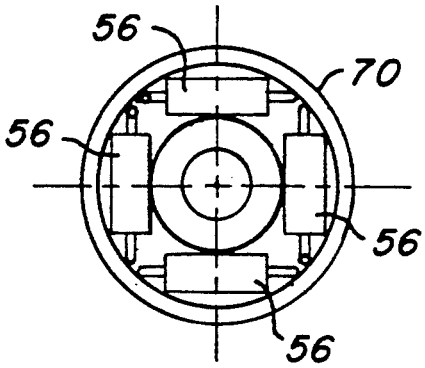
FIG. 10 is a front view along the section B—B of FIG. 8 illustrating the resisters mounted in the resistor housing.

The ring-shaped connector 30 includes a step-down portion 64 and an inner ring-shaped portion 66. As illustrated best in FIGS. 4 and 7–10, this inner ring-shaped portion 66 abuts against a circular conductive layer 68 (FIG. 7) to which current from the connector 30 is passed. The connector 30 rotates relative to the circular conductive layer 68, which is included on the bottom surface of a cup-shaped dielectric portion 70. Leads 72 extend from the circular conductive layer 68 through the bottom of the dielectric portion 70 to respective ones of the four resisters 56, which are mounted inside the cup-shaped dielectric portion 70, as illustrated in FIGS. 8 and 10. A first dielectric sheet 74 essentially encloses the resistors 56 within the cup-shaped dielectric portion 70, forming a resistor housing. Four leads 76 extend from respective ones of the resisters 56 through the dielectric sheet 74 to a first conductive portion 78 on the outside or front-facing surface of the first dielectric sheet 74. This is best illustrated in FIG. 9, which is an A—A sectional view of FIG. 8. A second conductive portion 80 is also included on the outside surface of the dielectric sheet 74. The conductive portion 80 is electrically connected by a lead 82 to the positive feed for the bulb 28, which is best illustrated in FIG. 4.

Figure 11:
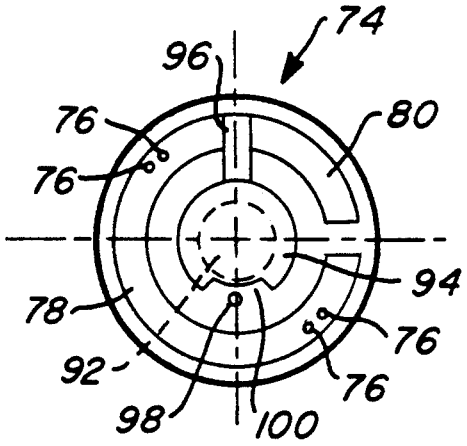
FIG. 11 is a front view of the front dielectric sheet illustrated in FIG. 9 having a switch mounted thereon.
Figure 12:
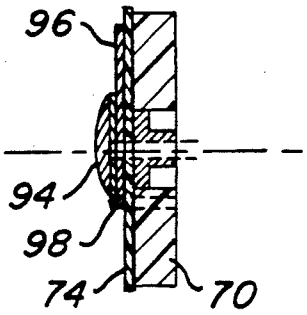
FIG. 12 is a side view, partially in cross section, illustrating the mounting of the switch of FIG. 11 on the resistor housing.

Referring now to FIGS. 4 and 7 through 12, the interior of the connector 30 has a non-conductive portion 90 formed therein. The non-conductive portion 90 supports a shaft 92 which is rotatable with the connector 30 relative to the housing 15 of the flashlight 10. The shaft 92 extends through inner openings in the dielectric portion 70 and the dielectric sheet 74 and is formed having a conductive head 94 which functions as the positive contact to the battery 60. A conductive arm 96 which is mounted on the shaft 92 and is in electrical contact with the head 94 serves as the wiper switch 58. The conductive arm 96 extends radially from the shaft 92, as best illustrated in FIGS. 11 and 12. A stop pin 98 is mounted on the dielectric sheet 74 within a cutaway circumferential portion of the head 94 for limiting the rotation of the head 94 and thus the arm 96, shaft 92 and the connector 30. In FIG. 11, the conductive arm 96 is shown between the first and second conductive portions 78, 80 (see FIG. 9). By rotating the conductive arm 96 to the left, the battery 60 is connected to the first conductive portion 78 and thereby to the connector 30 for recharging. By rotating of the conductive arm to the right in FIG. 11, the battery 60 is connected to the second conductive portion 80 and thereby to the bulb 28 via the lead 82 for causing illumination.

Referring once again to FIG. 4, the battery 60 is housed within an area defined by the rear cylindrical portion 12. Preferably, the battery 60 is a 1.2 volt nickel cadmium battery selected so that it will fit within the area defined by the rear cylindrical portion 12. The rear cylindrical portion 12 is threadedly connected to the front cylindrical portion 14 by threads 102.

Figure 13:
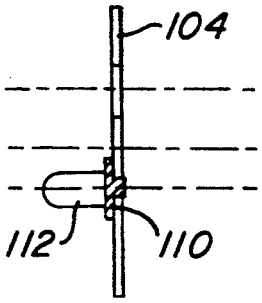
FIG. 13 is a cross-sectional side view of a dielectric sheet mounted between the battery and the lens/lamp assembly.
Figure 14:
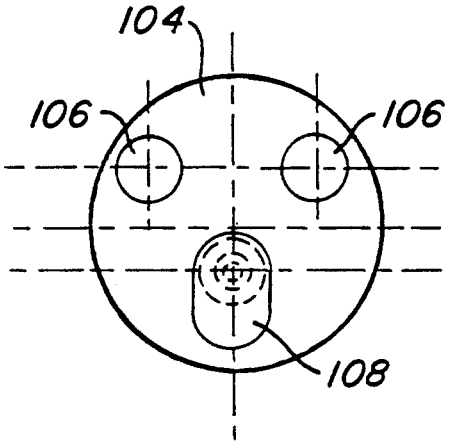
FIG. 14 is a rear view, partially in cross section, of the dielectric sheet of FIG. 13.

A second dielectric sheet 104 is mounted so as to enclose the rear of the front cylindrical portion 14. Side and rear end views of the dielectrical sheet 104 are provided in FIGS. 13 and 14, respectively. The dielectric sheet 104 includes two clearance holes 106 for battery contact springs (not shown). The battery contact springs are mounted between the battery 60 and the second dielectric sheet 104, with portions thereof extending through respective holes 106. The springs act as a portion of the negative lead for the battery 60 and function to hold the battery against the positive contact of the conductive head 94. At least one of the battery contact springs feeds a lead (not shown) which electrically connects the springs to the negative (ground) lead of the bulb 28 and to a conductive portion of the housing 15 which is in electrical contact with the inner opening 40 of the cigarette lighter receptacle, which is in contact with the negative terminal of the automobile battery. The rear surface of the second dielectric sheet 104 also includes a conductive layer portion 108 to which the end of the lead 82 from the second conductive portion 80 at the wiper switch 58 is connected. As best illustrated in FIG. 13, the conductive layer portion 108 is electrically connected to a lead 110 which extends through the second dielectric sheet 104. A post 112 is mounted on a portion of the lead 110 on the front surface of the dielectric sheet 104. A lamp contact spring (not shown) is mounted over the post 112 so that it is in electrical contact with the lead 110 and the positive contact of the bulb 28.

As best illustrated in FIG. 4, the lens/lamp assembly 26 is threadedly mounted to the front cylindrical portion 14 by threads 114. This permits removal of the lens/lamp assembly 26 from the housing 15. Preferably, the major portion of the lens/lamp assembly 26 is formed from molded plastic which includes recesses for holding at least one spare bulb 116. In this way, the consumer is provided with a nearly fail-safe source of emergency light, since the flashlight 10 should be maintained in a fully charged condition and the only component that has a limited life, the bulb, is replaceable by self-contained spare bulbs. The bulbs 28, 116 are preferably bi-pin bulbs, and the bulb 28 can easily be changed by removing the lens/lamp assembly 26 from the housing 15, popping out a plastic lens 118, pulling out the bad bulb 28 and replacing it with one of these spare bulbs 116.

SECOND EMBODIMENT

A flashlight according to the second embodiment of the present invention is designed for automobiles having cigarette lighter receptacles which are normally stowed or hidden from view. This flashlight is designed to be shorter in length than the flashlight 10 of the first embodiment. Differences between the two designs are discussed below.

Figure 15B:
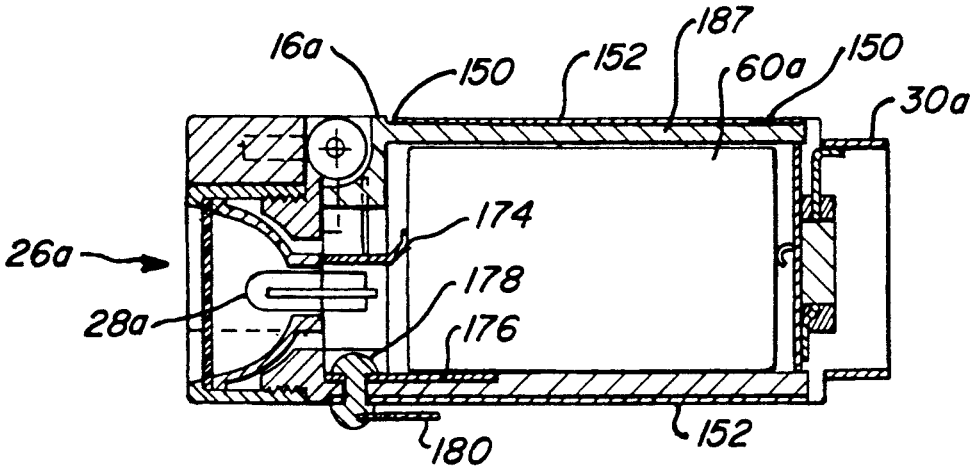
FIG. 15B is a cross-sectional side view of the flashlight of FIG. 15A.

Referring now to FIG. 15A, a flashlight 10*a* according to the second embodiment includes a cylindrical housing 15*a*. The housing 15*a* is a plastic casing formed by injection molding. The exterior surface of the housing 15*a* includes a substantially circumferential groove 150 which can be located either toward the rear or toward the front of the housing 15*a*. The groove 150 is illustrated in both positions in FIG. 15A. The groove 150 is useful in the mounting of an adapter so that the flashlight 10*a* can be used with automobile cigarette lighter receptacles having diameters larger than those found in the two receptacles primarily employed in the United States. These other receptacles include some of European design, which are commonly slightly greater in diameter than the two primary types found in the United States. The adapter and its use will be explained below.

Preferably, a portion of the housing 15*a* to the rear of the groove 150 is covered by a cylindrical conductive portion 152. This conductive portion 152 can be a pipe ring collar which is press fit onto the housing 15*a*. This conductive portion 152 serves the same purpose as the rear cylindrical portion in the first embodiment. The conductive portion 152 establishes electrical contact with nibs for connecting the flashlight 10*a* to ground or the negative portion of an automotive electrical system, as discussed relative to the first embodiment.

Like the flashlight 10 of the first embodiment, the housing 15*a* of the flashlight 10*a* includes a cutaway portion 16*a* in which a hinged magnetic foot 18*a* is mounted. The hinged magnetic foot 18*a* in the second embodiment is similar to the magnetic foot 18 of the first embodiment but in the second embodiment functions to connect a lamp assembly 26*a* to a rechargeable flashlight battery 60*a* for causing the lamp assembly 26*a* to illuminate, as will be explained below. The second portion of 24*a* of the magnetic foot 18*a* is illustrated as having faceted edges. This permits the flashlight assembly 10*a* to be placed on an inclined surface without risking that the flashlight assembly 10*a* will roll away. The facet corners also preferably extend beyond the surface of a cylinder defined by the housing 15*a* to prevent the flashlight 10*a* from being inserted backwards into a cigarette lighter receptacle. These features are best illustrated in the front view provided by FIG. 15C.

An adaptor 154 is illustrated in FIG. 16. The adapter 154 permits the flashlight 10*a* to be employed with cigarette lighter receptacles having larger diameters than the receptacles typically found in the United States. The adapter 154 is a somewhat cylindrical ribbed structure which slips over the body of the flashlight 10*a*. A ridged ring-shaped edge 156 engages the groove 150 to provide a secure fit. A plurality of bowed ribs 158 are resilient and provide an expanded diameter for the flashlight 10*a* so that contact with the nibs of the larger diameter cigarette lighter assemblies will be achieved.

As mentioned, rotation of the magnetic foot 18*a* about its hinge 20*a* switches the flashlight on and off. This will now be explained in more detail. An exploded perspective view of a bulb plug assembly 170 is provided in FIG. 17. As can be best appreciated from FIG. 15B, the positive and negative pins of a bulb 28*a* are shortened and/or bent to help reduce the overall length of the flashlight 10*a*. The assembly 170 is located between the bulb 28*a* and the battery housing. The negative pin of the bulb 28*a* is fit into a negative feed portion 172 of the assembly 170 so that contact is made with a conductive negative lead 174. A spring bias is provided between the lead 174 and the body of the assembly 170 at the negative feed portion so that the negative pin is held in place by friction from the spring bias. A second end of the negative lead 174 is also spring biased and extends into the battery housing so that a negative connection is provided to the bulb 28*a* from the battery 60*a*. The spring biasing of the negative lead 174 serves to maintain the positive connection at the opposite end of the battery 60*a*, as will be explained below.

In the second embodiment, the battery 60*a* is preferably a non-jacketed battery. The battery 60*a* is connected to ground or the negative lead of the automotive electrical system by a negative contact 176. The contact 176 is attached at one end to a rivet 178 which extends through the housing 15*a* and provides contact to the cylindrical conductive portion 152, which provides the ground or negative contact, as described above. The outside head of the rivet 178 can have a connecting device 180 attached thereto for permitting the flashlight 10*a* to be connected to a key chain or the like. A rubber seal (not shown) is provided within the housing 15*a* where the rivet extends through the housing 15*a* to prevent water or moisture from entering the flashlight 10*a* at this point and thereby maintaining the waterproof characteristic of the flashlight 10*a*.

The assembly 170 also includes a positive contact portion 182 into which the positive pin of the bulb 28*a* is fit so that contact is provided between the positive pin and a positive lead 184. Like the negative pin, the positive pin is held in place by a spring bias between the positive lead 184 and the corresponding portion of the body of the assembly 170. By sliding the pins into the assembly 170 such that friction holds them in place, the bulb 28*a* is held in place.

Figure 17:
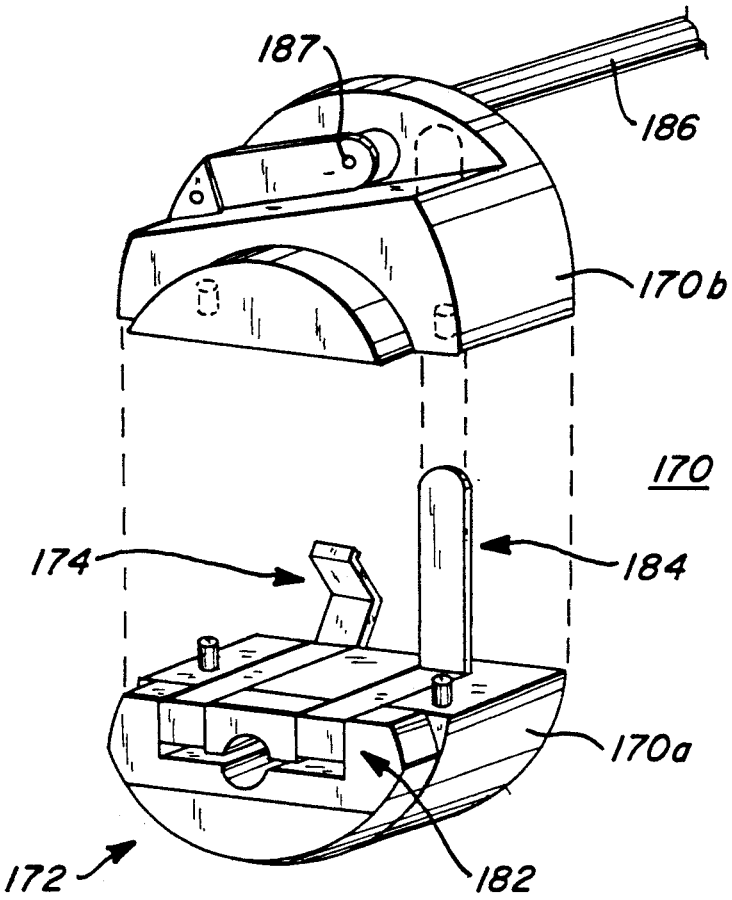
FIG. 17 is an exploded perspective view of a bulb receptacle assembly according to the second embodiment of the present invention.

As illustrated in FIG. 17, the portion 170 can comprise two main portions 170*a*, 170*b* which are snap fit together during assembly. One end of the positive lead 184 extends through an opening in the top portion 170*b* toward the portion of the flashlight 10*a* at which the hinged foot 18*a* resides. The end of the positive lead 184 is positioned relative to the hinged magnetic foot 18*a* and an end of insulated wire 186 so that when the hinged foot 18*a* is in a closed position it exerts magnetic force on a spring loaded armature 187. This pulls the armature away from the positive lead 184 and the insulated wire 186 and keeps the circuit open. However, when the magnetic foot 18*a* is rotated about its hinge 20*a* to an open position, the magnetic foot 18*a* magnetically releases the armature 187, which due to its spring loading moves into a position such that an electrical connection is provided therethrough between the positive lead 184 and the insulated wire 186. When insulated wire 186 is electrically connected to the positive feed of the battery 60*a*, the bulb 28*a* will be turned on.

Figure 18B:
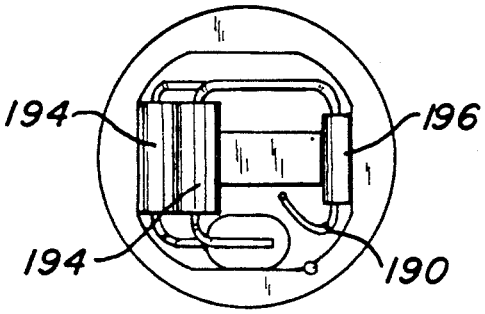
FIG. 18B is a top view of the resistor/diode housing of FIG. 18A.
Figure 18A:
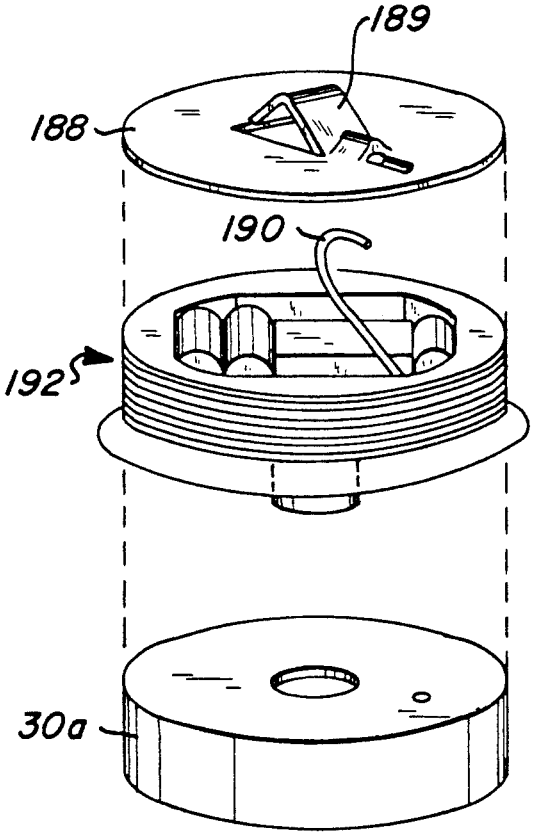
FIG. 18A is an exploded perspective view of the positive battery connection, resistor/diode housing and connector assembly portion of the rechargeable flashlight according to the second embodiment of the present invention.

The insulated wire 186 is connected to the positive terminal of the battery 60*a* in the following way. In this embodiment, the insulated wire 186 extends through the battery housing next to the non-jacketed battery 60*a* (thereby necessitating the insulation on the wire 186) to the rear end of the battery housing. The rear end of the battery housing is enclosed by a plate 188 which includes a spring biased portion 189 which provides the positive contact to the positive terminal of the battery 60*a*. Preferably, the plate 188 is formed from a conductive material with both an end of the insulated wire 186 and a wire 190 from a resistor/diode housing 192 being connected to the plate 188. The plate 188 also covers one end of the resistor/diode housing 192. As illustrated in a top view in FIG. 18B, a pair of current limiting and voltage reducing resistors 194 and a zener diode 196 are mounted within the housing 192. As discussed above relative to FIG. 1, the resistors 194 are mounted in parallel and preferably function to reduce the incoming voltage to one-tenth of its original voltage. The zener diode 196 then functions to permit charge to flow to the battery 60*a* via the lead 190 for charging the battery 60*a* if the automobile engine is on (and the automobile battery producing 14 volts), to prevent voltage from flowing to the battery when the automobile battery is off (and the output voltage is 12 volts), and to prevent charge from flowing back from the battery 60*a* into the automotive electrical system.

As with the first embodiment, the resistors 194 are connected to a ring-shaped connector 30*a*. However, in this embodiment, the ring-shaped connector 30*a* is not rotatable relative to the housing 15*a*. Like in the first embodiment, the ring-shaped connector 30*a* provides the connection to the corresponding positive engaging portions of the cigarette lighter receptacle. Since the ring-shaped portion 30*a* is not rotatable, it is a relatively simple matter to provide a waterproof joint between the ring-shaped connector 30*a*, the housing 15*a* and the housing 192 so that the flashlight 10*a* will be substantially waterproof.

Thus, the present invention provides reliable flashlights using the above-described structures. The hinged magnetic foot allows the flashlights to be used in a number of locations and situations in which it is difficult to employ prior art flashlights. The magnetic foot permits the flashlights to be mounted on any magnetically responsive material and permits the light beam to be directed as desired.

Figure 19:
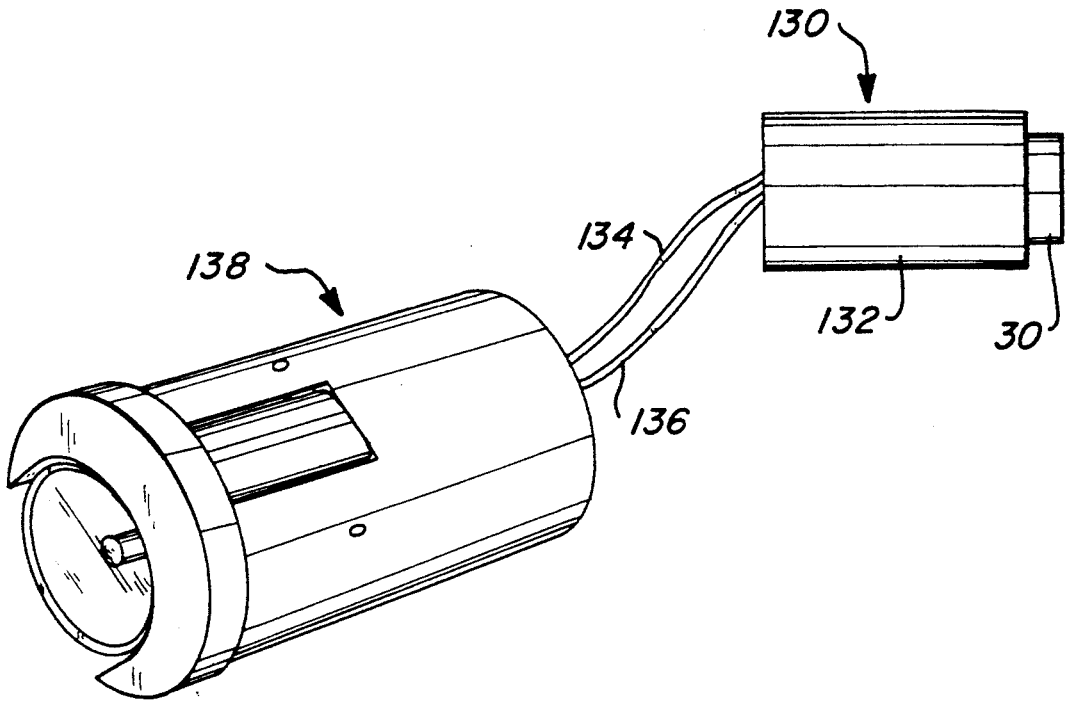
FIG. 19 is a perspective view of a separate universal connector and rechargeable flashlight according to the present invention.

The embodiments of the present invention described above are directed to an integral body. This need not be the case. For example, a flashlight which provides more light via a larger bulb and reflector can be provided, for example, by separating the connector from the flashlight body. Such an embodiment is illustrated in FIG. 19. In FIG. 19, the ring-shaped connector 30 is mounted at the rear end of a plug 130. The plug 130 includes a conductive cylinder 132 for contacting the negative feed of the cigarette lighter receptacle in the same way as the rear cylindrical portion 12 of the flashlight described above. Plug 130 should have a total length greater than the length of the deepest of the cigarette lighter receptacles so that the plug 130 can be easily inserted and removed from the cigarette lighter assembly. Positive and negative leads 134, 136 extend from the plug 130 to a flashlight body 138, which can include all the features of the flashlight portion of the rechargeable flashlight 10 described above. The leads 134, 136 should be designed for easy hook-up to and removal from the flashlight 138. A current limiting portion can be included either in the plug 130 or in the flashlight 138. One of any number of switches can be employed by the flashlight 138, including a rotatable switch mounted at the rear of the flashlight 138.

Such a plug 130 need not be used in combination with a flashlight. The ring-shaped connector 30 in combination with a conductive cylinder establishes a superior electrical connection with all types of cigarette lighter receptacles now prevalent. Thus, such a plug 130 can be reliable source of current for a wide variety of electrical appliances, including those which draw relatively significant amounts of current. When combined with an appropriate adapter for changing the current to a desired level, the plug 130 can be employed with a wide variety of electrical appliances. Typically, in such applications the connector 30 will not be rotatable with respect to the body of plug 130. The leads 134, 136 will extend to (and may be removable from) the appliance or appropriate current adaptor, in which appropriate switching means will be resident.

While several embodiments of the present invention have been discussed, it will be appreciated by those skilled in the art that various modifications and variations are possible without departing from the spirit and scope of the invention.

What is claimed is:

1. A device for drawing current from either one of two electric cigarette lighter receptacles, each of which has a cylindrical inner surface serving as a negative contact surface for each of two respective cigarette lighters with an open outer end and a closed inner end to which is connected to a U-shaped spring bracket that is electrically insulated from the inner surface and formed with spaced spring prongs extending toward the open outer end and serving as a pair of positive contacts for each of the two respective cigarette lighters, the prongs in the first one of the two receptacles having a first greater spacing from each other so as to engage the first cigarette lighter and the prongs in other of the two receptacles having a second lesser spacing from each other so as to engage the second cigarette lighter, said device comprising:

a generally cylindrical housing having a first end with a conductive surface, said housing being receivable in the receptacle so that said conductive surface of said housing is brought into electrical contact with the negative contacting surface of the receptacle, said housing having a second end; and a conductive cylindrical ring, having an outer peripheral surface and an inner peripheral surface, connected to and extending from said second end of said housing, which is electrically insulated from said conductive surface of said housing, said ring having a diameter intermediate the spacing between the prongs of the one receptacle and the spacing between the prongs of the other receptacle so that when said second end of said housing is inserted into the first receptacle said outer periphery surface of said cylindrical ring makes positive electrical contact with the prongs in the first receptacle and when said second end of said housing is inserted into the second receptacle said inner peripheral surface of said cylindrical ring makes positive electrical contact with the prongs of the second receptacle.

2. A device according to claim 1, further comprising: at least two current receiving means; and means for selectively connecting said conductive cylindrical ring electrically to one of said at least two current receiving means.

3. A device according to claim 2, wherein said cylindrical ring is rotatable relative to said housing for selectively connecting said cylindrical ring electrically to said at least two current receiving means.

4. A device according to claim 3, wherein one of said at least two current receiving means include at least a rechargeable battery and an electrical light assembly.

5. A device according to claim 5, wherein said device further comprises a first and second lead operatively connected to said electrically conductive surface and said conductive cylindrical ring, respectively, said first and second leads being attachable to an electrical device for providing electricity thereto from either one of two electric cigarette lighter receptacles.

6. A device according to claim 1, further comprising:

a battery mounted within said housing, said battery being selectively connectable to said conductive cylindrical ring; and a lamp assembly mounted within said housing.

7. A device according to claim 6, wherein said lamp assembly is selectively connectable to either of said battery and said conductive cylindrical ring for drawing electricity therefrom.

8. A device according to claim 6, further comprising magnetic switching means for selectively connecting said battery to said lamp assembly.

9. A device according to claim 8, further comprising a magnetic foot hingedly mounted to said housing, wherein pivoting said magnetic foot actuates said magnetic switching means.

10. A rechargeable flashlight assembly attachable to a cigarette lighter assembly having an open first end, an inner surface and extending portions in a region defined by the inner surface for supplying a current, comprising:

a housing having first and second ends and a cutaway portion;

a magnetic foot mounted on a hinge within the cutaway portion;

a lamp assembly includes a lamp and is mounted in the first end of said housing;

a rechargeable battery mounted within said housing electrically connected to said lamp; and means for frictionally engaging at least a portion of the extending portions for establishing an electrical connection thereto.

11. A rechargeable flashlight assembly according to claim 10, further comprising means for switchably connecting said rechargeable battery, said lamp assembly and said engaging means.

12. A rechargeable flashlight assembly according to claim 11, wherein said engaging means includes a ring-shaped portion for frictionally engaging at least the portion of the extending portions of the cigarette lighter assembly, said engaging means extending from the second end of said housing.

13. A rechargeable flashlight assembly according to claim 12, wherein the ring-shaped portion is rotatable relative to said housing for selectively electrically connecting said rechargeable battery, said lamp assembly and said engaging means.

14. A rechargeable flashlight assembly according to claim 10, wherein said lamp assembly is removable from said housing and includes at least one spare bulb and at least one holder for holding the spare bulb, at least one said holder and said spare bulb being accessible when said lamp assembly is removed from said housing.

15. A rechargeable flashlight assembly according to claim 10, wherein said housing further comprises a cylindrical portion substantially coextensive to a region proximate to the second end thereof, a diameter of the cylindrical portion being substantially similar to a diameter of the open first end of the cigarette lighter assembly, for frictionally engaging the inner surface and establishing an electrical connection thereto.

16. A rechargeable flashlight assembly according to claim 15, wherein the cylindrical portion provides a negative electrical connection to the cigarette lighter assembly and said engaging means provides a positive electrical connection to said cigarette lighter assembly.

17. A rechargeable flashlight assembly according to claim 10, further comprising magnetic switching means for selectively electrically connecting said lamp assembly to said battery.

18. A rechargeable flashlight assembly according to claim 15, further comprising:

magnetic switching means for selectively electrically connecting said lamp assembly to said battery, wherein said magnetic switching means is actuated by pivoting said magnetic foot about the hinge.

19. A rechargeable flashlight assembly according to claim 10, wherein said engaging means extends from the second end of said housing and said housing is substantially cylindrical for insertion into the cigarette lighter assembly.

* * * * *